US012313345B2

(12) United States Patent
Tada et al.

(10) Patent No.: US 12,313,345 B2
(45) Date of Patent: May 27, 2025

(54) COLD STORAGE INCLUDING A SLIDING DOOR HAVING A VERTICAL DRAIN

(71) Applicant: PHC Holdings Corporation, Tokyo (JP)

(72) Inventors: Minoru Tada, Ehime (JP); Mitsuyuki Shirata, Ehime (JP); Takumi Nishimura, Ehime (JP)

(73) Assignee: PHC Holdings Corporation, Tokyo (JP)

( * ) Notice: Subject to any disclaimer, the term of this patent is extended or adjusted under 35 U.S.C. 154(b) by 56 days.

(21) Appl. No.: 18/452,356

(22) Filed: Aug. 18, 2023

(65) Prior Publication Data

US 2023/0392877 A1 Dec. 7, 2023

Related U.S. Application Data

(63) Continuation of application No. PCT/JP2022/004482, filed on Feb. 4, 2022.

(30) Foreign Application Priority Data

Mar. 10, 2021 (JP) ..... 2021-038276

(51) Int. Cl.
*F28D 20/00* (2006.01)

(52) U.S. Cl.
CPC ..... *F28D 20/0034* (2013.01)

(58) Field of Classification Search
CPC ..... F28D 20/0034; F25D 2321/147; F25D 23/021; F25D 21/14
USPC ..... 165/10
See application file for complete search history.

(56) References Cited

FOREIGN PATENT DOCUMENTS

| | | | | |
|---|---|---|---|---|
| JP | S51-140544 | U | | 11/1976 |
| JP | 08219621 | A | * | 8/1996 |
| JP | 2000253967 | A | * | 9/2000 |
| JP | 2009066296 | A | * | 4/2009 |
| JP | 5448664 | B2 | * | 3/2014 |

OTHER PUBLICATIONS

International Search Report dated Mar. 8, 2022 issued in International Patent Application No. PCT/JP2022/004482, with English translation.

* cited by examiner

*Primary Examiner* — Steve S Tanenbaum
(74) *Attorney, Agent, or Firm* — Rimon P.C.

(57) ABSTRACT

A cold storage includes a box with an opening at front, a frame bordering the opening, a sliding door attached to the frame and including, in at least one of a left-side end portion and a right-side end portion, a drain channel extending vertically, and a porous body with water permeability, the porous body being attached to an upper surface of the sliding door to establish fluid communication with the drain channel.

6 Claims, 5 Drawing Sheets

COLD STORAGE INCLUDING A SLIDING DOOR HAVING A VERTICAL DRAIN

CROSS-REFERENCE OF RELATED APPLICATIONS

This application is a Continuation of International Patent Application No. PCT/JP2022/004482, filed on Feb. 4, 2022, which in turn claims the benefit of Japanese Patent Application No. 2021-038276, filed on Mar. 10, 2021, the entire disclosures of which Applications are incorporated by reference herein.

TECHNICAL FIELD

The present disclosure relates to a cold storage.

BACKGROUND ART

Patent Literature (PTL) 1 discloses a sash in which a guide groove for dew condensation water is formed in each of an upper frame of a sash window frame and a sash door stile to prevent intrusion of the dew condensation water into a room. The dew condensation water is guided to a lower frame of the sash window frame through the guide groove. The dew condensation water guided to the lower frame is drained through, for example, a drain hole formed in the lower frame.

CITATION LIST

Patent Literature

PTL 1
Microfilm of Japanese Utility Model Application No. S50-060830 (Japanese Utility Model Laid-Open No. S51-140544)

SUMMARY OF INVENTION

Technical Problem

In a cold storage for storing pharmaceuticals and so on at a low temperature, because a temperature difference between the inside and the outside of a storage chamber is relatively large, a relatively large amount of dew condensation water generates on a sliding door for opening and closing the storage chamber and on a frame to which the sliding door is attached, and the dew condensation water flows down toward a lower frame. When the relatively large amount of the dew condensation water falls down to the lower frame, the dew condensation water may remain on the lower frame in some cases without being completely drained through a drain hole.

An object of the present disclosure is to increase the efficiency in draining the dew condensation water in a cold storage.

Solution to Problem

In order to achieve the abovementioned object, a cold storage of the present disclosure includes: a box with an opening at front; a frame bordering the opening; a sliding door attached to the frame and including, in at least one of a left-side end portion and a right-side end portion, a drain channel extending vertically; and a porous body with water permeability, the porous body being attached to an upper surface of the sliding door to establish fluid communication with the drain channel.

Advantageous Effects of Invention

With the cold storage according to the present disclosure, the efficiency in draining the dew condensation water can be increased.

DESCRIPTION OF EMBODIMENTS

An embodiment of a cold storage according to the present disclosure will be described below with reference to the drawings. In the following description, it is assumed that, as denoted by arrows in FIG. 1, a side where left-side sliding door 30 and right-side sliding door 40 are disposed is a front side with respect to cold storage 1, and a side opposite to the above side is a rear side with respect to cold storage 1. Left and right sides when cold storage 1 is viewed from the front are respectively left and right sides with respect to cold storage 1. A side away from a plane on which cold storage 1 is installed is an upper side with respect to cold storage 1, and a side opposite to the above side is a lower side with respect to cold storage 1.

Figure 1:
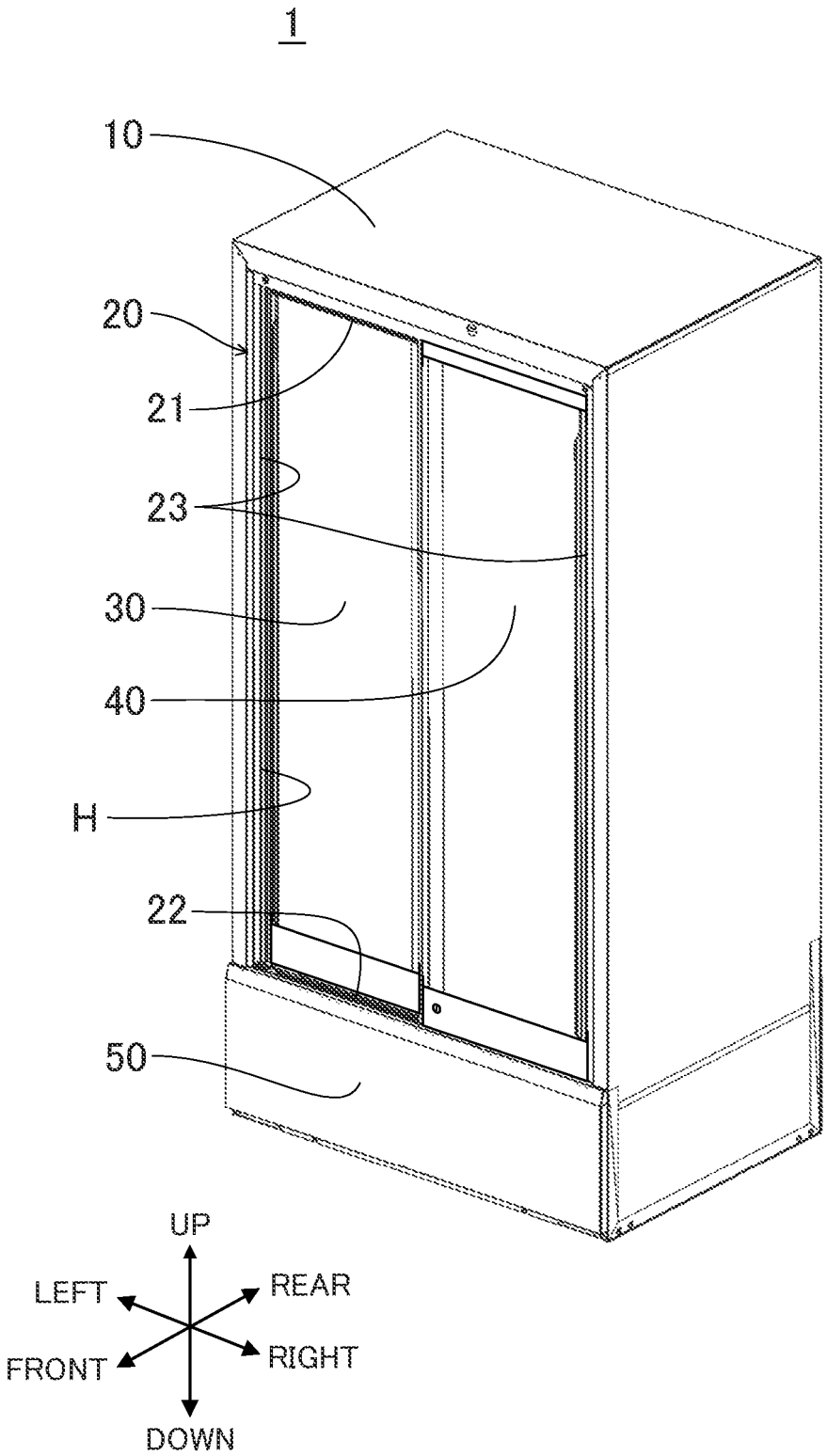
FIG. 1 is a perspective view of a cold storage according to an embodiment of the present disclosure.

Cold storage 1 is a pharmaceutical cold storage for storing pharmaceuticals at a low temperature. Cold storage 1 may be a cold storage for blood or a constant temperature container. As illustrated in FIG. 1, cold storage 1 includes box 10, frame 20, left-side sliding door 30, right-side sliding door 40, and machine storage chamber 50 in which members (not illustrated) constituting a refrigeration circuit are accommodated. Left-side sliding door 30 and right-side sliding door 40 are each an example of a "sliding door".

Box 10 has, in its front surface, opening H that provides an entrance opened and closed with movement of left-side sliding door 30 or right-side sliding door 40. A heat insulating material is filled between an outer surface and an inner surface of box 10. A space surrounded by the inner surface of box 10 serves as a storage chamber, namely a space in which pharmaceuticals are stored.

Frame 20 is attached to box 10 in such a way of bordering opening H. Left-side sliding door 30 and right-side sliding door 40 are disposed in frame 20 to be movable in a left-right direction. Left-side sliding door 30 moves on an inner side of the cold storage than right-side sliding door 40. Frame 20 includes upper frame 21, lower frame 22, and a pair of vertical frames 23.

Figure 2:
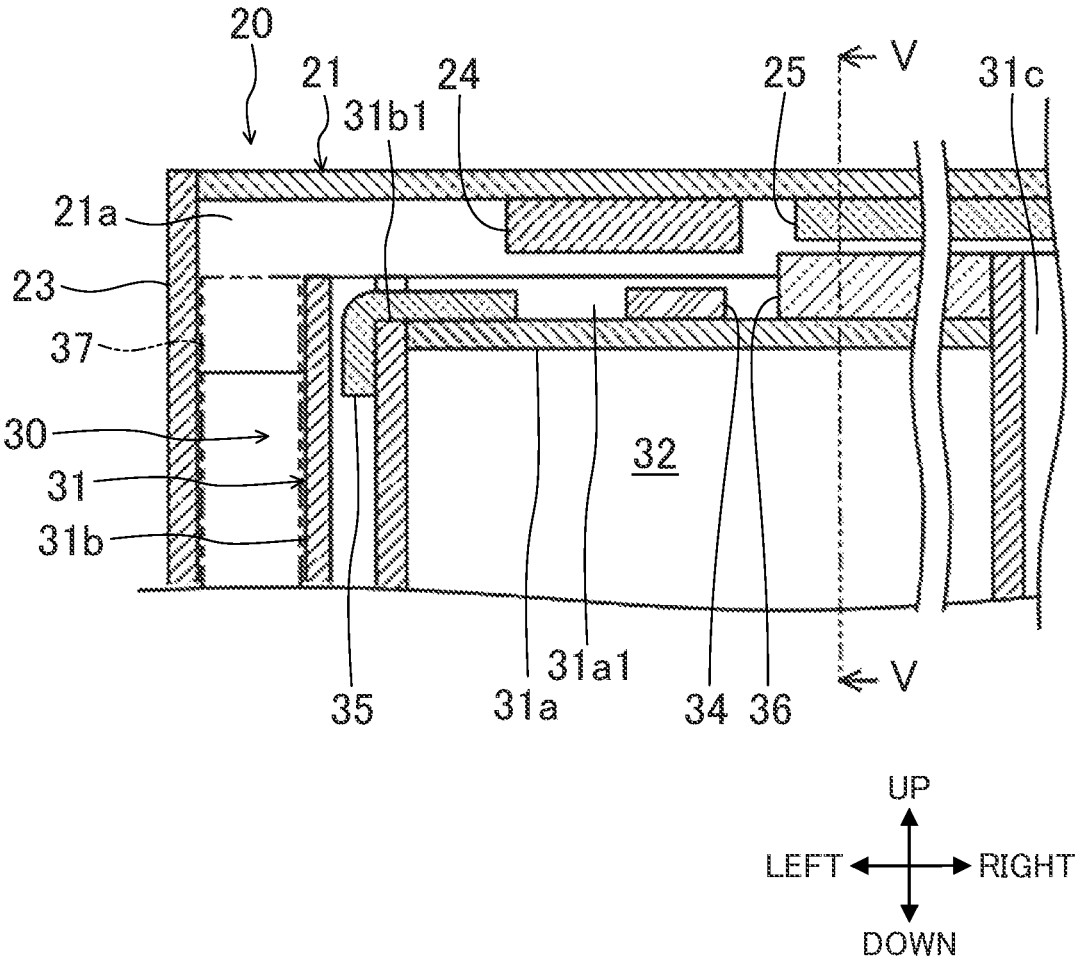
FIG. 2 is a sectional view illustrating an upper end portion of a sliding door and an upper end portion of a frame in a state in which the sliding door is closed.
Figure 5:
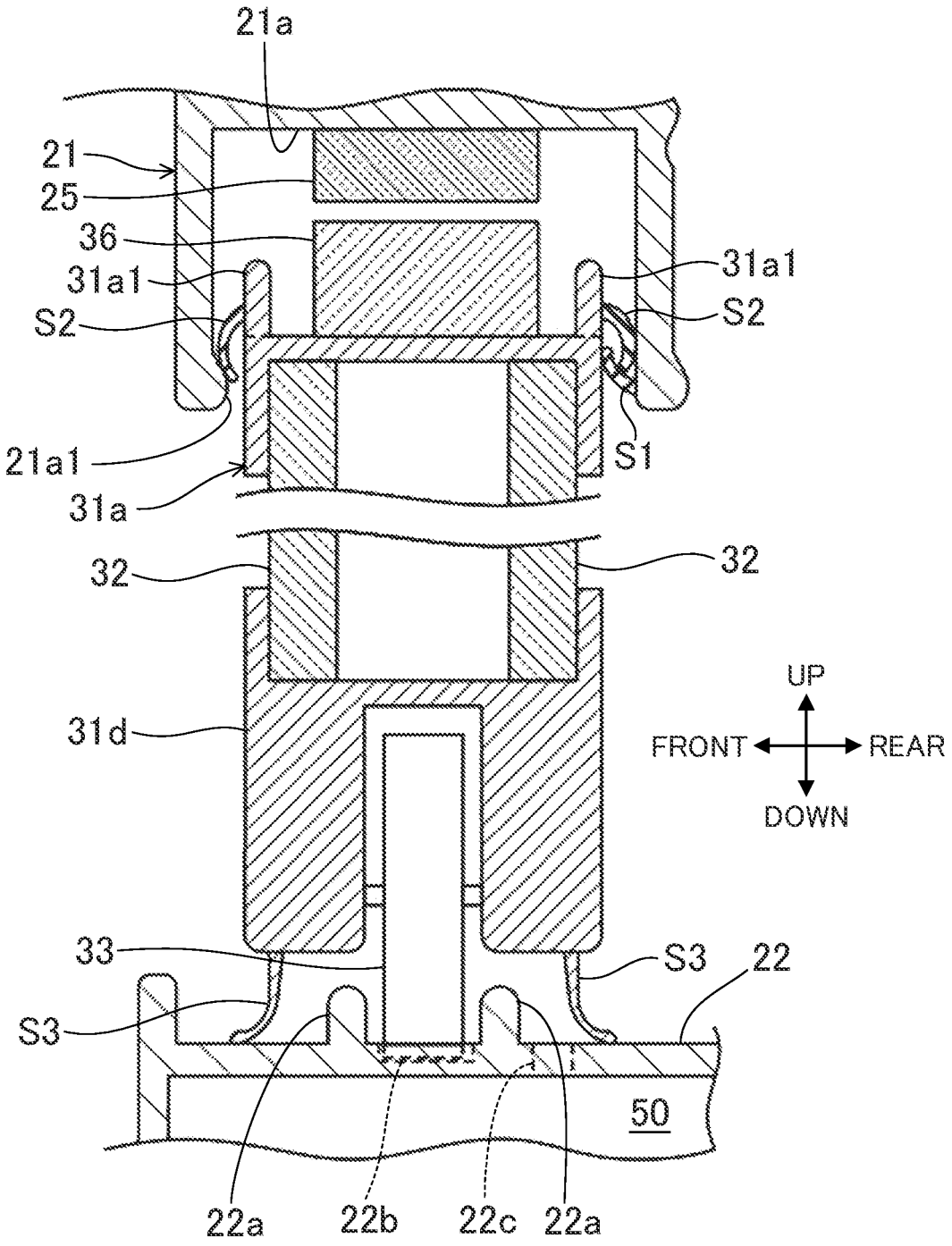
FIG. 5 is a sectional view taken along a line V-V in FIG. 2.

Upper frame 21 corresponds to an upper side portion of frame 20. As illustrated in FIGS. 2 and 5, upper frame 21 includes guide groove 21*a* for guiding left-side sliding door 30 in the left-right direction. Auxiliary sealing member S1 is disposed on a rear wall of guide groove 21*a* to extend in the left-right direction. Protruding portion 21*a*1 is formed in a lower end portion of a front wall of guide groove 21*a* to extend in the left-right direction. Details of auxiliary sealing member S1 and protruding portion 21*a*1 will be described later.

Opening/closing detection apparatus 24 and heat-insulating porous body 25 are attached to guide groove 21*a*. Opening/closing detection apparatus 24 and heat-insulating porous body 25 are attached to be held out of contact with left-side sliding door 30. Heat-insulating porous body 25 is an example of a "second porous body".

Opening/closing detection apparatus 24 detects opening/closing of left-side sliding door 30. Opening/closing detection apparatus 24 is, for example, a magnetic switch.

Heat-insulating porous body 25 is a porous body with heat insulation. Heat-insulating porous body 25 is a foam with an independent foam structure. Heat-insulating porous body 25 does not have water permeability. Heat-insulating porous body 25 is formed by using, for example, a polymer material such as polyethylene. Because heat-insulating porous body 25 is attached to upper frame 21, heat insulation at opening H can be increased. Heat-insulating porous body 25 may have a continuous foam structure with water permeability.

Heat-insulating porous body 25 is formed in a rectangular parallelepiped shape. Heat-insulating porous body 25 is attached to face an upper surface of left-side sliding door 30.

Figure 3:
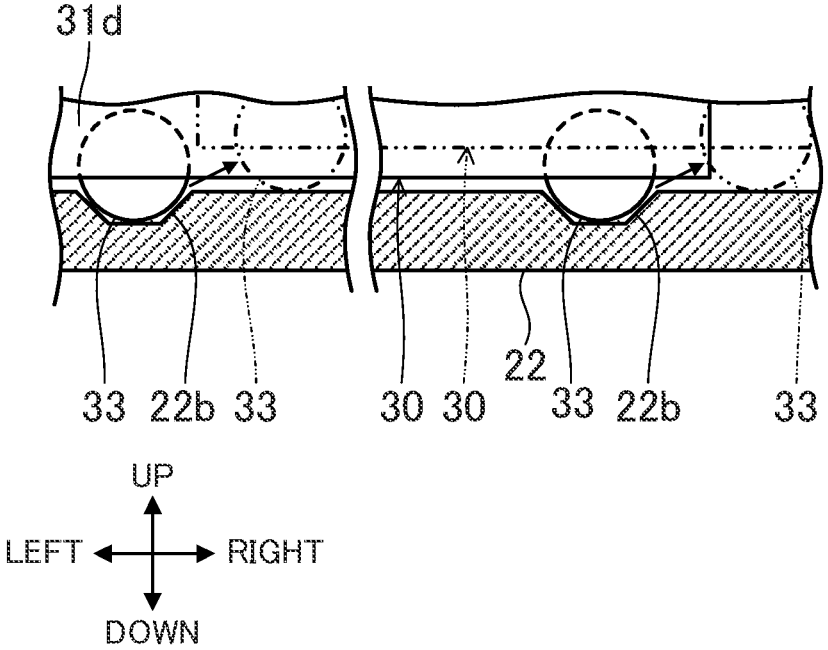
FIG. 3 illustrates a recessed portion of the frame and a door roller of the sliding door.
Figure 4:
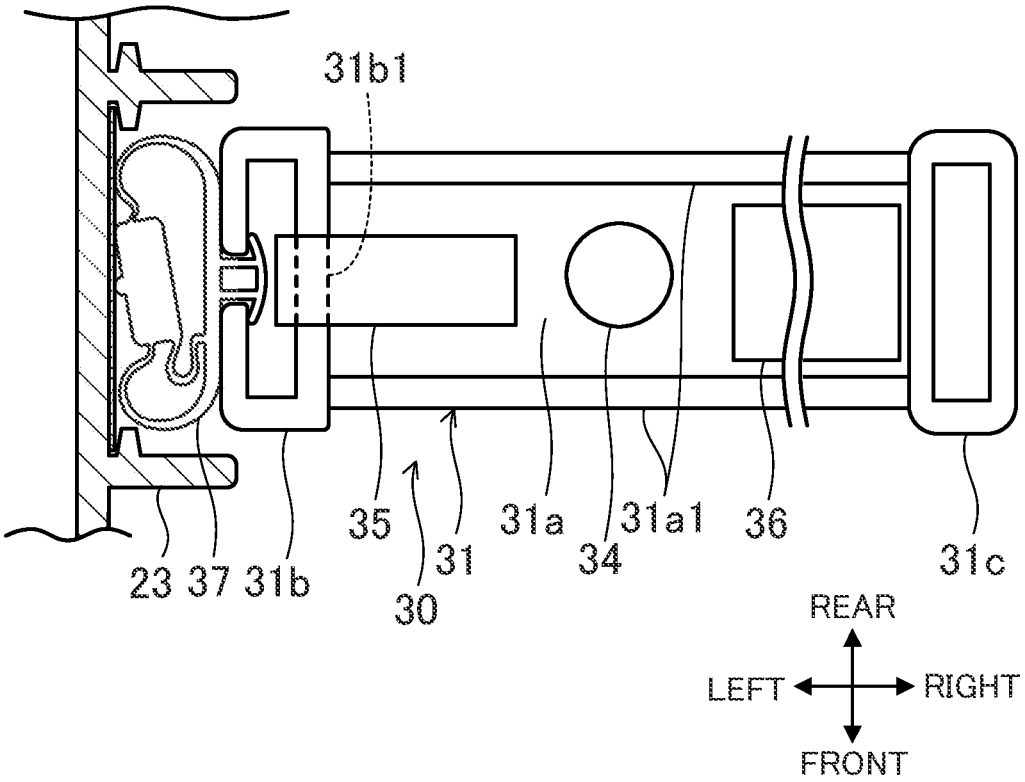
FIG. 4 is a horizontal sectional view of the sliding door in the state in which the sliding door is closed.

As illustrated in FIGS. 3 and 5, lower frame 22 includes a pair of rails 22*a*, recessed portion 22*b*, and drain outlet 22*c*.

The pair of rails 22*a* guide left-side sliding door 30. More specifically, the pair of rails 22*a* guide door roller 33 described later.

Recessed portion 22*b* is a portion into which door roller 33 (described later) falls when left-side sliding door 30 is closed and from which door roller 33 climbs up when left-side sliding door 30 is opened. Recessed portion 22*b* is formed in a dent shape between the pair of rails 22*a* on lower frame 22 in a region where left-side sliding door 30 is positioned when left-side sliding door 30 is closed (hereinafter also referred to as a "closed state"). Recessed portion 22*b* is formed in number corresponding to the number of door rollers 33. Because left-side sliding door 30 includes two door rollers 33, there are formed two recessed portions 22*b* corresponding to left-side sliding door 30. Furthermore, of two recessed portions 22*b* corresponding to left-side sliding door 30, recessed portion 22*b* on the left side is formed to be deeper than recessed portion 22*b* on the right side.

Drain outlet 22*c* is a through-hole that is opened to penetrate through lower frame 22. Drain outlet 22*c* causes the dew condensation water to be drained into machine storage chamber 50 through a drainpipe (not illustrated).

Upper frame 21 and lower frame 22 further include constituent elements for right-side sliding door 40, those constituent elements being similar to the above-described ones for left-side sliding door 30. The constituent elements for right-side sliding door 40, included in upper frame 21 and lower frame 22, are disposed on a side nearer to the outside of the cold storage than those for left-side sliding door 30. Because right-side sliding door 40 also includes two door rollers 33, there are formed two recessed portions 22*b* corresponding to right-side sliding door 40. Furthermore, of two recessed portions 22*b* corresponding to right-side sliding door 40, recessed portion 22*b* on the right side is formed to be deeper than recessed portion 22*b* on the left side.

As illustrated in FIGS. 2 to 5, left-side sliding door 30 includes frame-shaped stile member 31, a pair of glass plates 32 attached to stile member 31, and two door rollers 33. Stile member 31 includes upper stile 31*a*, left stile 31*b*, right stile 31*c*, and lower stile 31*d*. Note that FIGS. 2 to 5 illustrate left-side sliding door 30 in the closed state.

Upper stile 31*a* includes a pair of elongate portions 31*a*1. The pair of elongate portions 31*a*1 are disposed in a front end portion and a rear end portion of an upper surface of upper stile 31*a* and serve as sidewalls forming a trough. Right-side ends of the pair of elongate portions 31*a*1 are connected to each other by an upper end portion of right stile 31*c*. In other words, the upper surface of upper stile 31*a* is surrounded by the pair of elongate portions 31*a*1 and right stile 31*c* continuously along the rear end portion, a right-side end portion, and the front end portion of the upper surface. The upper surface of upper stile 31*a* corresponds to the upper surface of left-side sliding door 30.

Left stile 31*b* is constituted in the form of a tube extending in an up-down direction, being opened at opposite ends, and having a rectangular shape in a plan view. The inside of left stile 31*b* serves as a drain channel (described later) through which the dew condensation water passes. Thus, the drain channel is disposed in a left-side end portion of left-side sliding door 30. While the drain channel is disposed in the tubular form as described above, it may be disposed in the form of a groove. Moreover, left stile 31*b* includes cutout portion 31*b*1 that is formed by cutting an upper end portion of a right sidewall of left stile 31*b*.

Two door rollers 33 are attached to lower stile 31*d*. It is needless to say that the number of door roller 33 is not limited to two. With rotation of door rollers 33, left-side sliding door 30 moves along the pair of rails 22*a*.

Magnet 34, water-permeable porous body 35, and second water-permeable porous body 36 are further attached to the upper surface of left-side sliding door 30. Water-permeable porous body 35 and second water-permeable porous body 36 are each an example of a "porous body".

Magnet 34 is attached to be positioned to face opening/closing detection apparatus 24 in the state in which left-side sliding door 30 is closed. Magnet 34 activates opening/closing detection apparatus 24.

Water-permeable porous body 35 is a porous body with water permeability. Water-permeable porous body 35 is a foam with the continuous foam structure. Water-permeable porous body 35 is formed by using, for example, a polymer material such as polyethylene. Water-permeable porous body 35 has elasticity. Alternatively, water-permeable porous body 35 may be made of metal, non-woven fabric, felt, wood, ceramic, or the like.

Water-permeable porous body 35 is formed in a rectangular parallelepiped shape and is attached to a position on the left of magnet 34. An upper end of water-permeable porous body 35 is positioned lower than upper ends of the pair of elongate portions 31*a*1. Water-permeable porous body 35 is attached to the upper surface of left-side sliding door 30 (namely, the upper surface of upper stile 31*a*) to partially position inside left stile 31*b*. Because left stile 31*b* is in the tubular form being opened at the opposite ends as described above, a portion of water-permeable porous body 35 positioned inside left stile 31*b* extends downward and faces lower frame 22.

In more detail, water-permeable porous body 35 is attached to extend from the upper surface of left-side sliding door 30 to the inside of left stile 31*b*. Water-permeable porous body 35 has an L-like shape in a front view and is attached to a region spanning between the pair of elongate portions 31*a*1 on the upper surface of upper stile 31*a*, through cutout portion 31*b*1, and over an inner peripheral surface of left stile 31*b*. When water-permeable porous body 35 is formed of a flexible member, it may be attached in a manner of bending flexible member in a linear shape and bonding the same.

Second water-permeable porous body 36 is a porous body with water permeability. Second water-permeable porous body 36 is formed by using the same material as that of water-permeable porous body 35. The material properties of second water-permeable porous body 36 may be different from those of water-permeable porous body 35.

Second water-permeable porous body 36 is formed in a rectangular parallelepiped shape and is attached to the upper surface of upper stile 31*a* at a position on the right of magnet 34. An upper surface of second water-permeable porous body 36 is positioned higher than the upper ends of the pair of elongate portions 31*a*1. Second water-permeable porous body 36 is held out of contact with opening/closing detection apparatus 24 and heat-insulating porous body 25 when left-side sliding door 30 is opened and closed.

Left-side sliding door 30 further includes packing 37, a pair of upper sealing members S2, and a pair of lower sealing members S3. Packing 37, the pair of upper sealing members S2, and the pair of lower sealing members S3 seal between left-side sliding door 30 and frame 20 in the state in which left-side sliding door 30 is closed. In FIG. 2, packing 37 is denoted by a two-dot-chain line.

Packing 37 seals between left-side sliding door 30 and left-side vertical frame 23 when left-side sliding door 30 is in the closed state. Packing 37 is attached on the left side of left stile 31*b*. Packing 37 is held in contact with left-side vertical frame 23 when left-side sliding door 30 is in the closed state.

The pair of upper sealing members S2 seal between left-side sliding door 30 and upper frame 21 when left-side sliding door 30 is in the closed state. The pair of upper sealing members S2 are disposed on upper stile 31*a* to extend in the left-right direction. Upper sealing member S2 on the front side is held in contact with protruding portion 21*a*1 when left-side sliding door 30 is in the closed state. Upper sealing member S2 on the rear side is held in contact with auxiliary sealing member S1 when left-side sliding door 30 is in the closed state.

The pair of lower sealing members S3 seal between left-side sliding door 30 and lower frame 22 when left-side sliding door 30 is in the closed state. The pair of lower sealing members S3 are held in contact with an upper surface of lower frame 22 when left-side sliding door 30 is in the closed state.

Right-side sliding door 40 is constituted to be symmetrical to left-side sliding door 30 in the left-right direction. In more detail, a right stile of right-side sliding door 40 is constituted in the form of a tube extending in the up-down direction and being opened at opposite ends. The inside of the right stile of right-side sliding door 40 serves as a drain channel. Thus, the drain channel is formed in a right-side end portion of right-side sliding door 40.

Water-permeable porous body 35 attached to right-side sliding door 40 extends from an upper surface of right-side sliding door 40 to the inside of the right stile. Water-permeable porous body 35 and second water-permeable porous body 36 attached to right-side sliding door 40 may be different in shape, size, and so on from water-permeable porous body 35 and second water-permeable porous body 36 attached to left-side sliding door 30.

An operation of left-side sliding door 30 will be described below. In the closed state of left-side sliding door 30, door rollers 33 fall in recessed portions 22*b* in one-to-one relation (FIG. 3). Because, as described above, recessed portion 22*b* on the left-side, corresponding to left-side sliding door 30, is formed to be deeper than recessed portion 22*b* on the right side, the upper surface of left-side sliding door 30 inclines from the upper side toward the lower side as a position gradually goes toward the left from the right in the closed state of left-side sliding door 30. In other words, left-side sliding door 30 in the closed state is inclined such that its upper surface is positioned at a lower level on a side nearer to left stile 31*b* (namely, on a side nearer to the drain channel). Moreover, when left-side sliding door 30 is in the closed state, packing 37, the pair of upper sealing members S2, and the pair of lower sealing members S3 seal between left-side sliding door 30 and frame 20.

When left-side sliding door 30 is moved to the right, door rollers 33 climbs up from recessed portions 22*b*, and hence left-side sliding door 30 is elevated upward corresponding to the depths of recessed portions 22*b*. Thus, packing 37 departs away from left-side vertical frame 23, the pair of upper sealing members S2 depart away from protruding portion 21*a*1 and auxiliary sealing member S1, and the pair of lower sealing members S3 depart away from lower frame 22.

Figure 6:
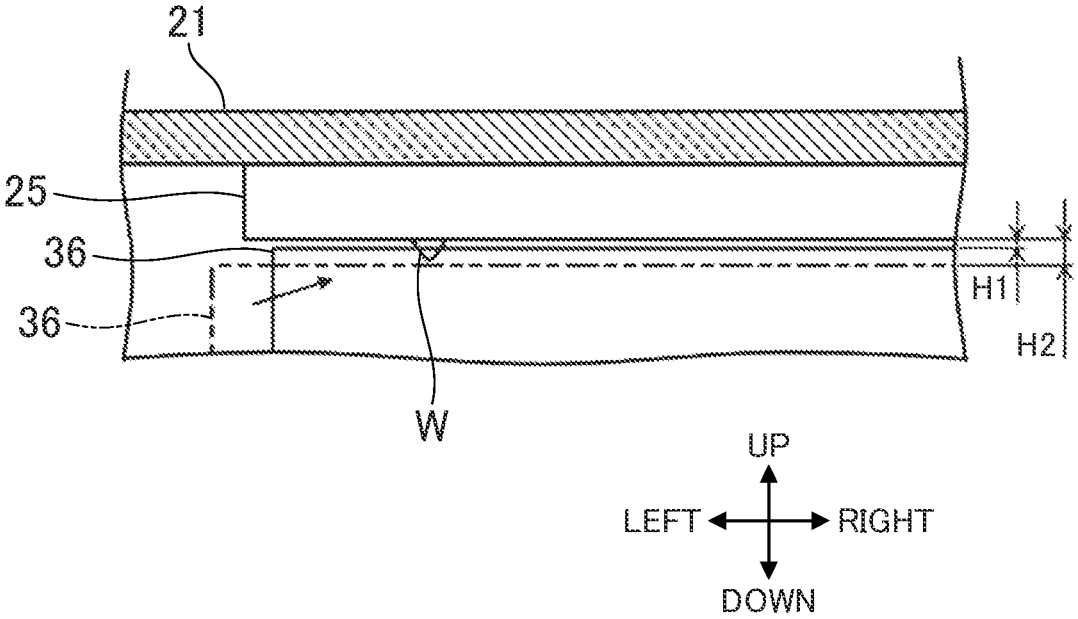
FIG. 6 illustrates a state in which the sliding door is moving.

Furthermore, second water-permeable porous body 36 approaches upper frame 21. More specifically, second water-permeable porous body 36 approaches heat-insulating porous body 25. In other words, when left-side sliding door 30 is moved, gap H1 between second water-permeable porous body 36 and heat-insulating porous body 25 becomes narrower than gap H2 between second water-permeable porous body 36 and heat-insulating porous body 25 when left-side sliding door 30 is closed (FIG. 6).

Left-side sliding door 30 is moved to the right along the pair of rails 22*a* while the narrowed gap between second water-permeable porous body 36 and heat-insulating porous body 25 is kept. When right-side sliding door 40 in the closed state is opened, right-side sliding door 40 operates in a similar way to the above-described operation of left-side sliding door 30 except for that right-side sliding door 40 is moved in a direction opposite to the movement of left-side sliding door 30 (namely to the left).

A flow path of the dew condensation water generating on upper frame 21 above left-side sliding door 30 in the closed state will be described below. The dew condensation water generates on upper frame 21 due to a temperature difference between the temperature in the storage chamber and the temperature of outside air. The dew condensation water generates on an inner surface of upper frame 21 and a surface of heat-insulating porous body 25. The dew condensation water having generated on upper frame 21 collects into a droplet and then falls down onto respective upper surfaces of second water-permeable porous body 36 and upper stile 31*a*.

The dew condensation water having fallen down onto second water-permeable porous body 36 passes through second water-permeable porous body 36 and flows onto the upper surface of upper stile 31*a*. Furthermore, as described above, the upper surface of left-side sliding door 30 inclines from the upper side toward the lower side as a position gradually goes toward the left from the right in the closed state of left-side sliding door 30. Accordingly, the dew condensation water having flowed onto the upper surface of upper stile 31*a* and the dew condensation water having fallen down from upper frame 21 to the upper surface of upper stile 31*a* are caused to flow to the left with the presence of the pair of elongate portions 31*a*1 and right stile 31*c* without flowing down along a front surface, a rear surface, and a right lateral surface of left-side sliding door 30.

The dew condensation water flowing to the left over the upper surface of upper stile 31*a* reaches water-permeable porous body 35. The dew condensation water having reached water-permeable porous body 35 passes through water-permeable porous body 35 and flows to the inside of left stile 31*b*. Because water-permeable porous body 35 has the continuous foam structure as described above, water-permeable porous body 35 acts as a resistance against a flow of the dew condensation water.

Thus, force of the flow of the dew condensation water is suppressed by water-permeable porous body 35. As a result, a flow speed, namely a flow rate per unit time, of the dew condensation water flowing from the upper surface of upper stile 31*a* to the inside of left stile 31*b* is suppressed.

The dew condensation water having flowed to the inside of left stile 31*b* passes through the inside of left stile 31*b*, flows to lower frame 22, and is then drained to machine storage chamber 50 through drain outlet 22*c*. Drain outlet 22*c* is set to a minimum required size to minimize the influence of the environment inside machine storage chamber 50 upon the environment inside the cold storage. If the flow rate of the dew condensation water per unit time is not suppressed and a large amount of the dew condensation water is delivered to the surrounding of drain outlet 22*c* at a time, the dew condensation water cannot smoothly pass through drain outlet 22*c* and spreads over the upper surface of lower frame 22. Once the dew condensation water spreads, the dew condensation water having spread up to a distant position away from drain outlet 22*c* cannot move back to drain outlet 22*c*. In other words, part of the dew condensation water is not drained and remains on the upper surface of lower frame 22. By contrast, in cold storage 1 according to this embodiment, the flow rate of the dew condensation water per unit time is suppressed. More specifically, the flow rate of the dew condensation water per unit time is suppressed to be equal to or smaller than a value at which drain outlet 22*c* allows the water to smoothly pass therethrough. Since the flow rate of the dew condensation water per unit time is suppressed by water-permeable porous body 35, the dew condensation water is drained through drain outlet 22*c* without remaining on lower frame 22. Accordingly, the efficiency in draining the dew condensation water can be increased with the presence of water-permeable porous body 35. Thus, the material properties and the size of water-permeable porous body 35 are preferably determined and set such that the flow rate of the dew condensation water passing through water-permeable porous body 35 per unit time is held equal to or smaller than the flow rate per unit time at which the dew condensation water can pass through drain outlet 22*c* by gravity alone.

In addition, when left-side sliding door 30 is moved as described above, second water-permeable porous body 36 approaches heat-insulating porous body 25. Accordingly, as illustrated in FIG. 6, second water-permeable porous body 36 scrapes off a droplet W of the dew condensation water present on the surface of heat-insulating porous body 25. Thus, when left-side sliding door 30 is opened and a sample or the like is taken out from the storage chamber, the dew condensation water can be prevented from falling down onto the sample or the like.

As described above, right-side sliding door 40 is constituted to be symmetrical to left-side sliding door 30 in the left-right direction. Moreover, because recessed portion 22*b* on the right side, corresponding to right-side sliding door 40, is formed to be deeper than recessed portion 22*b* on left side, the upper surface of right-side sliding door 40 inclines from the upper side toward the lower side as a position gradually goes toward the right from the left in the closed state of right-side sliding door 40. Accordingly, as with the above-described dew condensation water falling down onto the upper surface of left-side sliding door 30, the dew condensation water falling down onto the upper surface of right-side sliding door 40 passes through water-permeable porous body 35 and flows toward lower frame 22 through the inside of the right stile. In addition, as with above-described second water-permeable porous body 36 attached to left-side sliding door 30, second water-permeable porous body 36 attached to right-side sliding door 40 scrapes off a droplet of the dew condensation water generating on the heat-insulating porous body that is disposed to face the upper surface of right-side sliding door 40.

The present disclosure is not limited to the above-described embodiment. Configurations constituted by combining various modifications of the embodiment with each other also fall within the scope of the present disclosure insofar as those configurations do not depart from the gist of the present disclosure.

For example, while water-permeable porous body 35 and second water-permeable porous body 36 are attached to the upper surface of upper stile 31*a*, second water-permeable porous body 36 may not always need to be attached. Furthermore, a porous body obtained by integrating water-permeable porous body 35 and second water-permeable porous body 36 together may be attached. Another porous body with water permeability may be further attached in addition to water-permeable porous body 35 and second water-permeable porous body 36.

A size of the gap between second water-permeable porous body 36 and heat-insulating porous body 25 when left-side sliding door 30 is moved may be different from that between second water-permeable porous body 36 and heat-insulating porous body 25 when right-side sliding door 40 is moved. For example, the gap between second water-permeable porous body 36 and heat-insulating porous body 25 may be set to be narrower for one of left-side sliding door 30 and right-side sliding door 40 on which the dew condensation water is more apt to generate. This feature enables second water-permeable porous body 36 to more easily scrape off the dew condensation water for the one of left-side sliding door 30 and right-side sliding door 40 on which the dew condensation water is more apt to generate.

Heat-insulating porous body 25 may not always need to be attached to upper frame 21. When heat-insulating porous body 25 is not attached to upper frame 21, second water-permeable porous body 36 is formed such that, when left-side sliding door 30 and right-side sliding door 40 are each moved, second water-permeable porous body 36 approaches a portion of upper frame 21, the portion being positioned to face second water-permeable porous body 36, and scrapes off the droplet of the dew condensation water.

Figure 7:
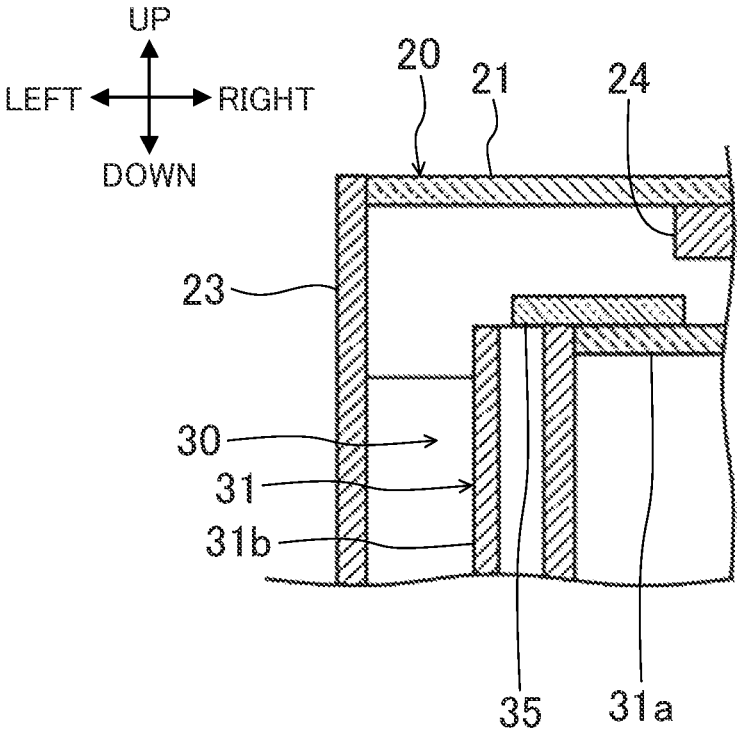
FIG. 7 is a sectional view of a cold storage according to a modification of the embodiment of the present disclosure.

While water-permeable porous body 35 has the L-like shape (FIG. 2), it may have a linear shape as illustrated in FIG. 7. In this case, water-permeable porous body 35 can be more easily manufactured. When water-permeable porous body 35 is formed in a flexible shape, water-permeable porous body 35 can be easily attached without bending the same in advance. Moreover, when the upper end of left stile

31*b* is at the same height as the upper surface of upper stile 31*a* as illustrated in FIG. 7, water-permeable porous body 35 formed in the linear shape is disposed to overlap with the inside of left stile 31*b* and to face lower frame 22 without being partially disposed inside left stile 31*b*.

While the inside of left stile 31*b* serves as the drain channel through which the dew condensation water passes, the drain channel may be further formed in the inside of right stile 31*cl*. In this case, right stile 31*c* is constituted in the form of a tube as with left stile 31*b*, and a porous body with water permeability may be attached to the upper surface of upper stile 31*a* to establish fluid communication with the inside of right stile 31*c*. When the drain channel is formed in each of the inside of left stile 31*b* and the inside of right stile 31*c*, the depths of two recessed portions 22*b* corresponding to left-side sliding door 30 may be set equal to each other such that the upper surface of left-side sliding door 30 does not incline in the closed state (namely, such that the upper surface of left-side sliding door 30 is substantially horizontal). The drain channel may not always need to be formed in the inside of left stile 31*b* and may be formed only in the inside of right stile 31*c*. When the drain channel is formed only in the inside of right stile 31*c*, the upper surface of left-side sliding door 30 may incline from the upper side toward the lower side as a position gradually goes toward the right from the left in the closed state of left-side sliding door 30. In this case, of two recessed portions 22*b* corresponding to left-side sliding door 30, recessed portion 22*b* on the right side is formed to be deeper than recessed portion 22*b* on the left side.

Each of left-side sliding door 30 and right-side sliding door 40 does not always need to include the pair of elongate portions 31*a*1.

While door rollers 33 are attached to lower stile 31*d*, they may be attached to upper stile 31*a*. When door rollers 33 are attached to upper stile 31*a*, left-side sliding door 30 and right-side sliding door 40 are each constituted as a suspended sliding door. Left-side sliding door 30 and right-side sliding door 40 may not always need to include door rollers 33. Moreover, the positions at which door rollers 33 are attached may be adjusted to make each of left-side sliding door 30 and right-side sliding door 40 inclined such that a portion of the upper surface of the sliding door on a side nearer to the drain channel is positioned at a relatively low level even during the movement of the sliding door.

The disclosure of Japanese Patent Application No. 2021-038276 filed on Mar. 10, 2021 including the specification, claims, drawings and abstract is incorporated herein by reference in its entirety.

INDUSTRIAL APPLICABILITY

The present disclosure can be widely applied to cold storages, such as a cold storage for pharmaceuticals, a cold storage for blood, and a constant temperature container.

REFERENCE SIGNS LIST

1 cold storage
10 box
20 frame
21 upper frame (upper side portion)
22*b* recessed portion
25 heat-insulating porous body (second porous body)
30 left-side sliding door (sliding door)
31 stile member
31*a* upper stile
31*a*1 elongate portion
33 door roller
35 water-permeable porous body (porous body)
36 second water-permeable porous body (porous body)
40 right-side sliding door (sliding door)
H opening

The invention claimed is:

1. A cold storage comprising:
a box with an opening at front;
a frame bordering the opening;
a sliding door attached to the frame and including, in at least one of a left-side end portion and a right-side end portion, a drain channel extending vertically; and
a porous body with water permeability, the porous body being attached to an upper surface of the sliding door to establish fluid communication with the drain channel.

2. The cold storage according to claim 1,
wherein the porous body is a foam with a continuous foam structure.

3. The cold storage according to claim 1,
wherein the porous body is attached to extend from the upper surface of the sliding door into the drain channel.

4. The cold storage according to claim 1,
wherein the sliding door includes a pair of elongate portions disposed at an upper end of the sliding door on a front side and a rear side and forming a trough.

5. The cold storage according to claim 1,
wherein the sliding door includes a door roller,
the frame includes a recessed portion into which the door roller falls when the sliding door is closed and from which the door roller climbs up when the sliding door is opened, and
the porous body approaches an upper side portion of the frame when the sliding door is opened.

6. The cold storage according to claim 1, further comprising:
a second porous body with heat insulation, the second porous body being attached to the frame to be positioned to face the upper surface of the sliding door in a closed state.

* * * * *